US012808589B2

(12) United States Patent
Wang et al.

(10) Patent No.: US 12,808,589 B2
(45) Date of Patent: Nov. 24, 2026

(54) VALVE MODULE AND HEAT PUMP SYSTEM

(71) Applicant: Carrier Corporation, Palm Beach Gardens, FL (US)

(72) Inventors: Chaojie Wang, Shanghai (CN); Xiaojun Guo, Shanghai (CN); Hui Zhai, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 101 days.

(21) Appl. No.: 18/439,515

(22) Filed: Feb. 12, 2024

(65) Prior Publication Data

US 2024/0271843 A1 Aug. 15, 2024

(30) Foreign Application Priority Data

Feb. 13, 2023 (CN) ..... 202310109171.7

(51) Int. Cl.
*F25B 49/02* (2006.01)
*F25B 30/02* (2006.01)

(52) U.S. Cl.
CPC ..... *F25B 49/02* (2013.01); *F25B 30/02* (2013.01); *F25B 2313/0233* (2013.01); *F25B 2313/029* (2013.01); *F25B 2313/031* (2013.01)

(58) Field of Classification Search
CPC .. F25B 49/02; F25B 30/02; F25B 2313/0233; F25B 2313/029; F25B 2313/031
See application file for complete search history.

(56) References Cited

U.S. PATENT DOCUMENTS

| | | | |
|---|---|---|---|
| 2019/0242602 | A1 | 8/2019 | Yamada et al. |
| 2021/0131706 | A1 | 5/2021 | Yamada et al. |
| 2022/0146158 | A1 | 5/2022 | Ohura et al. |
| 2022/0205693 | A1 | 6/2022 | Ikari et al. |

FOREIGN PATENT DOCUMENTS

| | | | | |
|---|---|---|---|---|
| CN | 108036551 | A | * | 5/2018 |
| EP | 1643196 | A1 | | 4/2006 |
| JP | 2019113258 | A | | 7/2019 |
| JP | 2022020401 | A | * | 2/2022 |

OTHER PUBLICATIONS

Hayashi et al., Air Conditioning Device, Feb. 1, 2022, JP2022020401A, Whole Documents (Year: 2022).*
Tan et al, Switching Device and Multi-Split Air Conditioner . . . , May 15, 2018, CN108036551A, Whole Document (Year: 2018).*
Extended European Search Report received for EP Application No. 24157158.7, mailed on Nov. 22, 2024, 21 Pages.

* cited by examiner

*Primary Examiner* — Larry L Furdge
(74) *Attorney, Agent, or Firm* — Drew Folgmann

(57) ABSTRACT

A valve module and a heat pump system are disclosed. The heat pump system includes: an outdoor unit, a plurality of indoor units, one or more valve modules, a plurality of sensors and a control device. The control device is connected to the plurality of sensors and configured to execute a local cut-off step upon receiving a signal indicating refrigerant leakage in a corresponding indoor unit sent from any sensor, the local cut-off step includes: closing the indoor unit throttling element of the indoor unit with leakage; and closing the corresponding branch control valve in the valve module connected to the indoor unit with leakage.

15 Claims, 3 Drawing Sheets

VALVE MODULE AND HEAT PUMP SYSTEM

CROSS REFERENCE TO RELATED APPLICATIONS

This application claims priority to Chinese Patent Application No. 202310109171.7 filed on Feb. 13, 2023, which is incorporated by reference herein in its entirety.

FIELD OF THE INVENTION

The invention relates to the field of heat pump systems, in particular to a valve module and a heat pump system.

BACKGROUND OF THE INVENTION

R32 is considered as a more environmentally friendly refrigerant which is most likely to replace traditional refrigerant R410A. However, R32 is flammable compared to R410A. For household or commercial air conditioning systems, if R32 is used as the refrigerant, it is necessary to prevent refrigerant leakage into indoor space. Some measures involve using stop valves and alarm systems.

SUMMARY OF THE INVENTION

The object of the present application is to solve or at least alleviate the problems existing in the prior art.

According to one aspect, a heat pump system is provided, comprising:

an outdoor unit comprising a liquid refrigerant port and a gaseous refrigerant port;

a plurality of indoor units, each indoor unit including a first port, an indoor unit throttling element, an indoor unit heat exchanger, and a second port that are sequentially connected;

one or more valve modules, each valve module connecting the outdoor unit to at least one indoor unit, wherein each valve module comprises:

at least one set of first and second internal ports connected respectively to the first port and the second port of at least one indoor unit;

a first external port connected to the liquid refrigerant port of the outdoor unit and a second external port connected to the gaseous refrigerant port of the outdoor unit;

a first flow path extending from the first external port to each of the first internal ports;

a second flow path extending from the second external port to each of the second internal ports, wherein branch control valve(s) is provided on the second flow path to control the on/off of the flow path from the second external port to each of the second internal ports respectively;

a plurality of sensors for monitoring refrigerant leakage in corresponding indoor units; and a control device, wherein the control device is connected to the plurality of sensors, and configured to execute a local cut-off step upon receiving a signal indicating refrigerant leakage in a corresponding indoor unit sent from any sensor, the local cut-off step comprising:

closing the indoor unit throttling element of the indoor unit with leakage; and closing the corresponding branch control valve in the valve module connected to the indoor unit with leakage.

Optionally, in an embodiment of the heat pump system, each valve module is connected to a plurality of indoor units;

wherein, the first flow path comprises: a first flow path main path and a plurality of first flow path branches extending from the first flow path main path to each of the first internal ports, where the first flow path main path is provided with a main path control valve;

wherein, the second flow path comprises: a second flow path main path and a plurality of second flow path branches extending from the second flow path main path to each of the second internal ports, where each second flow path branch is provided with a branch control valve;

wherein, the control device is configured to close the main path control valve and all branch control valves in the valve module connected to the indoor unit with leakage, when leakage is still detected in the indoor unit with leakage after executing the local cut-off step.

Optionally, in an embodiment of the heat pump system, said leakage still being detected in the indoor unit with leakage comprises: keeping the fan of the indoor unit heat exchanger of the indoor unit with leakage continuously operating, and sensing the presence of refrigerant leakage after a certain time delay.

Optionally, in an embodiment of the heat pump system, the outdoor unit further comprises a gas return port connected to the suction end of the compressor, the valve module further comprises an additional external port connected to the gas return port, wherein the valve module comprises a third flow path extending from the additional external port to each of the second internal ports, and the third flow path comprises a third flow path main path and a plurality of third flow path branches extending from the third flow path main path to each of the second internal ports, where each third flow path branch is provided with an additional control valve, and the local cut-off step further comprises: closing the corresponding additional control valve in the valve module connected to the indoor unit with leakage, wherein the control device is configured to close all additional control valves in the valve module connected to the indoor unit with leakage, when leakage is still detected in the indoor unit with leakage after executing the local cut-off step.

Optionally, in an embodiment of the heat pump system, the valve module further comprises an economizer;

wherein, each first flow path branch comprises: a first flow path forward branch and a first flow path return branch, where each first flow path forward branch is provided with a check valve that only allows fluid to flow to the corresponding first internal port, and each first flow path return branch is provided with a check valve that only allows fluid to flow to the first external port;

wherein, each of the first flow path return branches, after merging with each other, is connected to the first flow path main path after passing through the first path of the economizer, and wherein, a divisional branch branches out before or after the economizer, and the divisional branch is connected to the third flow path main path after passing through an additional throttling element and the second path of the economizer.

Optionally, a valve module for connecting an outdoor unit of a heat pump system to a plurality of indoor units is also provided, wherein the valve module comprises:

a plurality of sets of first and second internal ports respectively connected to a first port and a second port of a plurality of indoor units;

a first external port connected to a liquid refrigerant port of an outdoor unit and a second external port connected to a gaseous refrigerant port of the outdoor unit;

a first flow path extending from the first external port to each of the first internal ports, wherein the first flow path comprises: a first flow path main path and a plurality of first flow path branches extending from the first flow path main path to each of the first internal ports, where the first flow path main path is provided with a main path control valve; and a second flow path extending from the second external port to each of the second internal ports, wherein the second flow path comprises: a second flow path main path and a plurality of second flow path branches extending from the second flow path main path to each of the second internal ports, where each second flow path branch is provided with a branch control valve.

Optionally, in an embodiment of the valve module, the valve module further comprises: a control device connected to the main path control valve and all branch control valves, and configured to execute a local cut-off step upon receiving a signal indicating refrigerant leakage in any indoor unit connected to the valve module, where the local cut-off step comprises: closing the branch control valve corresponding to the indoor unit with leakage, wherein, the control device is further configured to close the main path control valve and all branch control valves upon receiving a signal indicating there is still leakage in the indoor unit with leakage after executing the local cut-off step.

Optionally, in an embodiment of the valve module, the valve module further comprises an additional external port connected to a gas return port of the outdoor unit, wherein the valve module comprises a third flow path extending from the additional external port to each of the second internal ports, and the third flow path comprises a third flow path main path and a plurality of third flow path branches extending from the third flow path main path to each of the second internal ports, where each third flow path branch is provided with an additional control valve.

Optionally, in an embodiment of the valve module, each first flow path branch comprises: a first flow path forward branch and a first flow path return branch, where each first flow path forward branch is provided with a check valve that only allows fluid to flow to the corresponding first internal port, and each first flow path return branch is provided with a check valve that only allows fluid to flow to the first external port. The valve module further comprises an economizer, wherein, each of the first flow path return branches, after merging with each other, is connected to the first flow path main path after passing through the first path of the economizer, and wherein, a divisional branch branches out before or after the economizer, and the divisional branch is connected to the third flow path main path after passing through an additional throttling element and the second path of the economizer.

Optionally, in an embodiment of the valve module, the valve module further comprises a control device configured to execute a local cut-off step upon receiving a signal indicating refrigerant leakage in any indoor unit connected to the valve module, where the local cut-off step comprises: closing the branch control valve corresponding to the indoor unit with leakage, and closing the additional control valve corresponding to the indoor unit with leakage;

wherein, the control device is further configured to close the main path control valve, all branch control valves and all additional control valves upon receiving a signal indicating there is still leakage in the indoor unit with leakage after executing the local cut-off step.

Optionally, in an embodiment of the valve module, the valve comprises: a first connecting external port connected to the first external port through a direct-through pipeline, a second connecting external port connected to the second external port through a direct-through pipeline, and an additional connecting external port connected to the additional external port through a direct-through pipeline.

A control method for a heat pump system is further provided, the heat pump system comprising: an outdoor unit, a plurality of indoor units, and at least one valve module, where each valve module connects the outdoor unit to at least two indoor units of the plurality of indoor units, wherein the method comprises:

executing a local cut-off step upon detecting refrigerant leakage in any indoor unit, wherein the local cut-off step comprises:

closing the indoor unit throttling element of the indoor unit with leakage; and closing the branch control valve on the second flow path branch extending from the second external port to the second internal port corresponding to the indoor unit with leakage in the valve module connected to the indoor unit with leakage.

Optionally, the local cut-off step further comprises: closing the additional control valve on the third flow path branch extending from the additional external port to the second internal port corresponding to the indoor unit with leakage in the valve module connected to the indoor unit with leakage.

Optionally, the method further comprises: closing the main path control valve on the first flow path main path of the first flow path extending from the first external port to each of the first internal ports in the valve module connected to the indoor unit with leakage, upon detecting that there is still leakage in the indoor unit with leakage after executing the local cut-off step; and closing all branch control valves and all additional control valves in the valve module connected to the indoor unit with leakage.

Optionally, the step of detecting there is still leakage in the indoor unit with leakage comprises: keeping the fan of the indoor unit heat exchanger of the indoor unit with leakage continuously operating, and sensing the presence of refrigerant leakage after a certain time delay.

The valve module, heat pump system, and related control method according to the embodiments disclosed herein can effectively prevent continuous refrigerant leakage into the room, and have minimal impact on other indoor units of the heat pump system.

BRIEF DESCRIPTION OF THE DRAWINGS

With reference to the accompanying drawings, the disclosure of the present application will become easier to understand. Those skilled in the art would easily understand that these drawings are for the purpose of illustration, and are not intended to limit the protection scope of the present application. In addition, in the figures, similar numerals are used to denote similar components, where.

DETAILED DESCRIPTION OF EMBODIMENT(S) OF THE INVENTION

A heat pump system according is described with reference to FIG. 1. The heat pump system mainly comprises: an outdoor unit 1, a plurality of indoor units 491, 492, 493, 494, and one or more valve modules 31, 32. In the illustrated embodiment, the heat pump system is configured with two valve modules 31 and 32, each configured to be connected to two indoor units, thereby connecting the four indoor units to the outdoor unit. In alternative embodiments, there may be four valve modules, each connected to a single indoor unit, or there may be one valve module connected to four indoor units. Similarly, depending on the number of indoor units, any suitable number of valve modules can be configured, and each valve module can be connected to any suitable number of indoor units.

Figure 1:
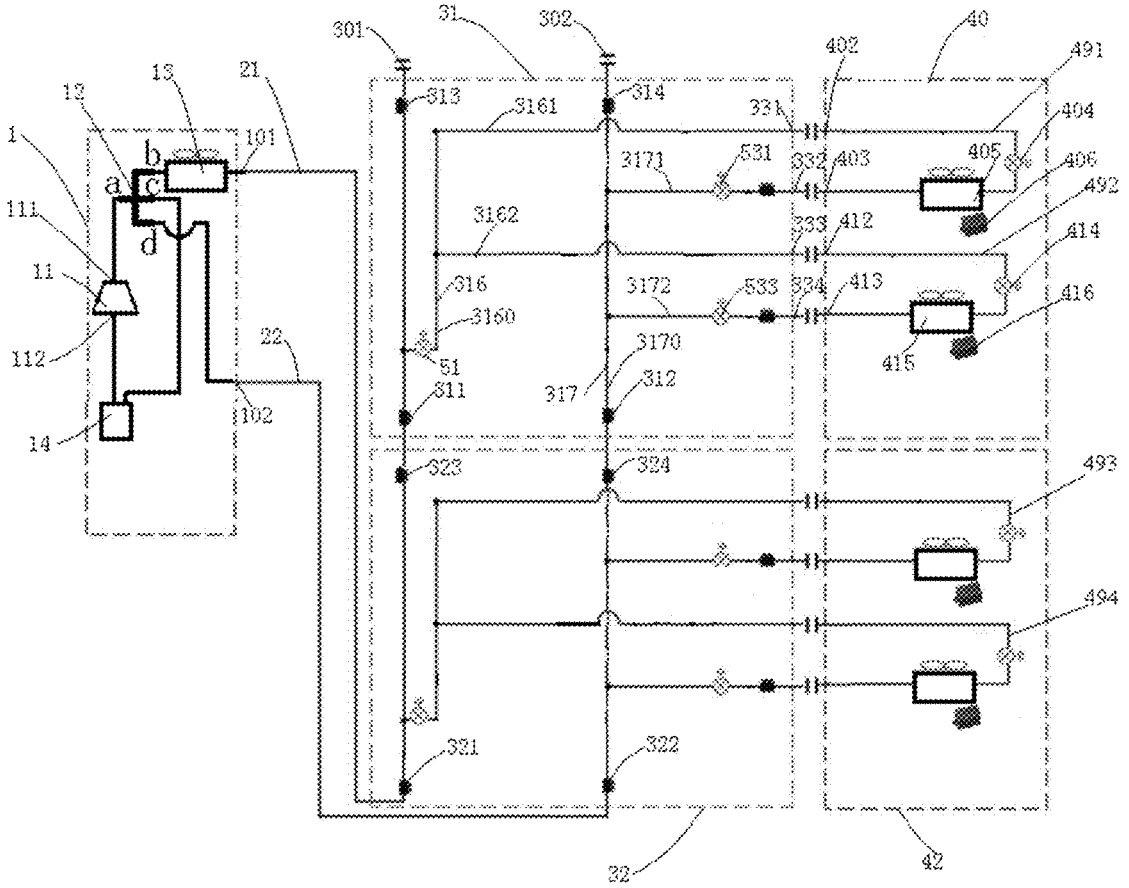
FIG. 1 shows a structural schematic diagram of a heat pump system according to an embodiment.

In the embodiment shown in FIG. 1, the outdoor unit 1 comprises: a liquid refrigerant port 101 and a gaseous refrigerant port 102. The outdoor unit 1 can execute different modes, such as the cooling mode or the heating mode, so as to transport refrigerant out of one of the gaseous refrigerant ports 102 and the liquid refrigerant ports 101 and receive the returned refrigerant from the other. In a specific embodiment, the outdoor unit 1 may comprise a compressor 11, which includes an exhaust port 111 and an suction port 112, and a four-way valve 12 comprising four ports a, b, c, and d, wherein port a of the four-way valve 12 is connected to the exhaust port 111 of the compressor, port c is connected to the suction port 112 of the compressor through a gas-liquid separator 14, port b is connected to the liquid refrigerant port 101 through the outdoor unit heat exchanger 13, and port d is connected to the gaseous refrigerant port 102. By switching the four-way valve 12, port a can be connected to port b, and port c to port d, thereby achieving the output of liquid refrigerant from the liquid refrigerant port 101 in the cooling mode, or port a can be connected to port d, and port b to port c, thereby achieving the output of gaseous refrigerant from the gaseous refrigerant port 102 in the heating mode. It should be appreciated that the specific embodiment of the outdoor unit illustrated is only illustrative, and various outdoor units for heat pump systems known in the art can be applied to the present application.

For the plurality of indoor units, taking the first and second indoor units 491, 492 connected to the first valve module 31 as examples, the first and second indoor units 491, 492 respectively include first ports 402, 412, indoor unit throttling elements 404, 414, indoor unit heat exchangers 405, 415, and second ports 403, 413 that are sequentially connected. When the cooling mode is executed in the indoor unit, liquid refrigerant flows into the indoor unit from the first port 402, is throttled at the indoor unit throttling element 404 and evaporated at the indoor unit heat exchanger 405 and flows out from the second port 403. When the heating mode is executed in the indoor unit, conversely, gaseous refrigerant flows in from the second port 403, is condensed through the indoor unit heat exchanger 405 and throttled at the indoor unit throttling element 404 and flows out from the first port 402. Each indoor unit can correspond to an area within a residential or commercial facility, such as a room. In addition, in the embodiments disclosed herein, a plurality of sensors 406, 416 are also provided, which detect refrigerant leakage of the corresponding indoor units. For example, each sensor can be located near the air outlet of the indoor unit heat exchanger to detect whether there is refrigerant leakage into the room. In alternative embodiments, a single indoor unit heat exchanger may be provided with a plurality of sensors, or the sensors may be arranged in any other suitable locations. As shown in the figure, the third and fourth indoor units 493, 494 connected to the second valve module 32 may have the same or similar structure, which will not be repeated here.

For valve modules, taking the first valve module 31 as an example, the first valve module 31 comprises: at least one set of first internal port 331, 333 and second internal port 332, 334 respectively connected to first port 402, 412 and second port 403, 413 of at least one indoor unit. In this embodiment, the first valve module 31 includes a first set of first internal port 331 and second internal port 332 connected to the first indoor unit 491, and a second set of first internal port 333 and second internal port 334 connected to the second indoor unit 492; a first external port 311 connected to the liquid refrigerant port 101 of the outdoor unit through a first pipeline 21 and a second external port 312 connected to the gaseous refrigerant port 102 of the outdoor unit through a second pipeline 22. In the illustrated embodiment, each valve module comprises: first connecting external ports 313, 323 connected to the first external ports 311, 321 through a direct-through pipeline and second connecting external ports 314, 324 connected to the second external ports 312, 322 through a direct-through pipeline. And, the first external port 311 and the second external port 312 of the first valve module 31 are connected to the liquid refrigerant port 101 and the gaseous refrigerant port 102 of the outdoor unit through the first connecting external port 323 and the second connecting external port 324 of the second valve module 32 and the direct-through pipelines inside the second valve module 32, thereby facilitating the stacked connection of more valve modules. Whereas, the first external port 321 and the second external port 322 of the first stacked valve module (i.e., the second valve module 32 in the figure) are directly connected to the liquid refrigerant port 101 and the gaseous refrigerant port 102 of the outdoor unit, while the first connecting external port 313 and the second connecting external port of the last stacked connected valve module (i.e., the first valve module 31 in the figure) can be blocked. Although there are two valve modules stacked in the illustrated embodiment, more valve modules can be stacked and installed in this manner. In alternative embodiments, the first and second external ports 321 and 322 of each valve module can also be directly connected to the liquid refrigerant port 101 and the gaseous refrigerant port 102 of the outdoor unit.

Each valve module further comprises: a first flow path 316 extending from the first external port 311 to each of the first internal ports 331, 333; and a second flow path 317 extending from the second external port 312 to each of the second internal ports 332, 334. The second flow path 317 includes: a second flow path main path 3170, and a plurality of second flow path branches 3171, 3172 extending from the second flow path main path to each of the second internal ports 332, 334. Each second flow path branches 3171, 3172 is provided with a branch control valve 531, 533, such as solenoid valves. In addition, the heat pump system also provides a control device, which is connected to the plurality of sensors, and configured to execute a local cut-off step when any of the sensors detects refrigerant leakage in the corresponding indoor unit and sends a signal to the control device. The local cut-off step comprises: closing the indoor unit throttling element of the indoor unit with leakage and closing the corresponding branch control valve in the valve module connected to the indoor unit with leakage, thereby cutting off the connection between the second external port and the second internal port of the indoor unit with leakage. The heat pump system, upon detecting refrigerant leakage in the indoor unit, will directly close the indoor unit throttling element and cut off the connection between its second port with the outdoor unit, so that the refrigerant will not be circulating into the indoor unit with leakage, so as to avoid continuous refrigerant leakage to a concentration that is prone to fire. At the same time, such local disconnection will not affect the normal operation of other indoor units.

For example, when the sensor 406 corresponding to the first indoor unit 491 detects refrigerant leakage, the indoor unit throttling element 404 of the first indoor unit 491 and the branch control valve 531 on the second flow path branch 3171 in the first valve module 31 connected to the first indoor unit 491 are closed, thereby cutting off both ends of the corresponding indoor unit heat exchanger 405. This local cut-off step can disconnect the indoor unit heat exchanger 405 of the first indoor unit from the heat pump system, thereby preventing the refrigerant circulating in the heat pump system from continuously leaking into the room. At the same time, this step will not affect the normal operation of other indoor units 492, 493, 494.

In some embodiments, the first flow path 316 may include: a first flow path main path 3160 and a plurality of first flow path branches 3161, 3162 extending from the first flow path main path to each of the first internal ports 331, 333, wherein the first flow path main path 3160 is provided with a main path control valve 51, such as a solenoid valve. In some embodiments, the control device is further configured to close the main path control valve and all branch control valves of the valve module connected to the indoor unit with leakage when it is detected that there is still leakage in the indoor unit with leakage after executing the local cut-off step. For example, if refrigerant leakage is still found after executing the above local cut-off step, it is possible that the indoor unit throttling element 404 is not completely closed or is leaking. At this point, the entire associated valve module is cut off from the outdoor unit to prevent further refrigerant leakage into the room, without affecting the normal operation of the indoor units connected to the outdoor unit through other valve modules. Also taking the indoor unit 491 as an example, if refrigerant leakage is still found after executing the above local cut-off step, the main path control valve 51 and other branch control valve 533 of the first valve module 31 is further closed. At this point, the entire first valve module 31 is disconnected, so that there will be no continuous refrigerant leakage into the room. However, the indoor units 493, 494 connected to the second valve module 32 can still work normally. In some embodiments, in order to accurately determine whether there is still refrigerant leakage, the fan of the indoor unit heat exchanger of the indoor unit with leakage can be kept continuously operating, and it can be sensed after a certain time delay whether there is still refrigerant leakage. For example, after execution of the local cut-off step upon the initial detection of refrigerant leakage in the indoor unit 491, the fan of the indoor unit heat exchanger 405 of the indoor unit 491 with leakage is kept operating to blow away the initial refrigerant leakage. Then, after a time delay of, for example, 30 seconds, the refrigerant concentration near the wind blowing port is monitored again to see if it still exceeds the threshold. If it does not exceed the threshold, the above local cut-off step is considered effective, as no new refrigerant is transported indoors. If it still exceeds the threshold, it is considered that there is still continuous refrigerant leakage. At this point, the above operation of cutting off the entire valve module will be executed.

Figure 2:
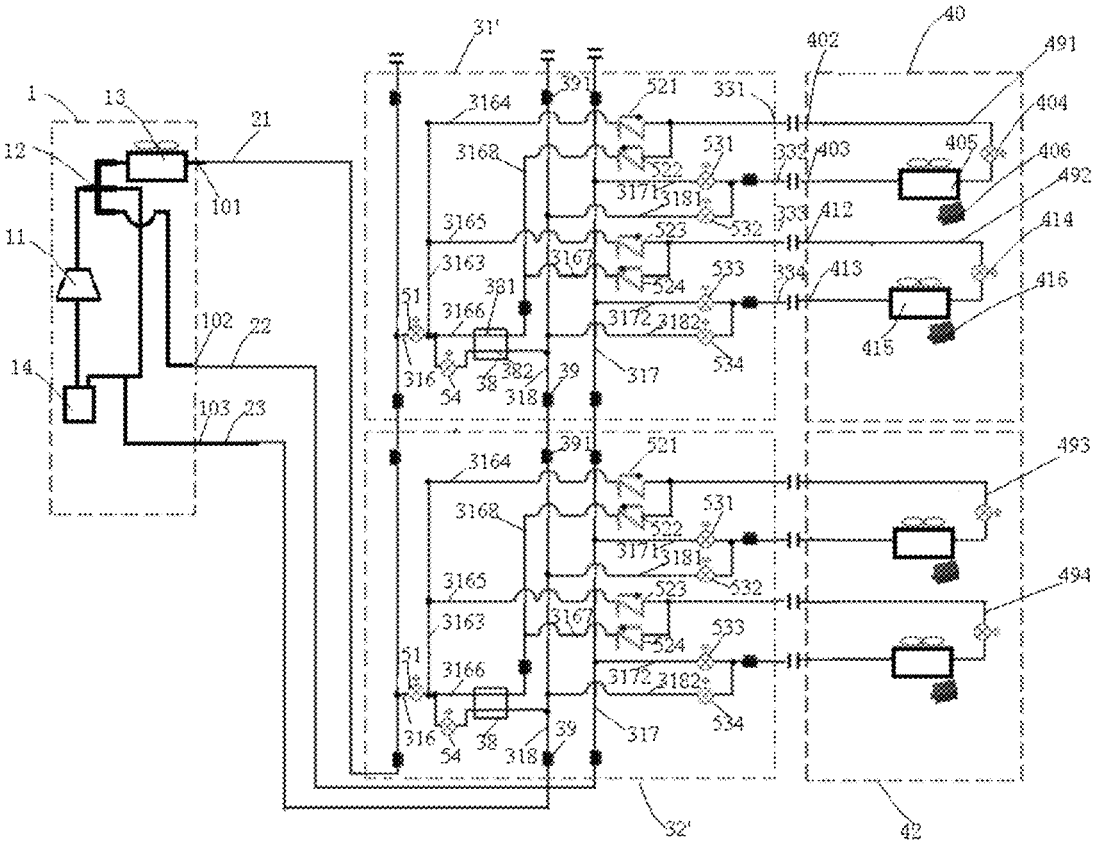
FIG. 2 shows a structural schematic diagram of a heat pump system according to another embodiment.

With continued reference to FIG. 2, a heat pump system according to another embodiment is described, wherein modified valve modules 31' and 32' are used. In this embodiment, the structures of the indoor units and sensors are the same as those described in conjunction with FIG. 1. The outdoor unit further comprises a gas return port 103 connected to the suction end of the compressor. The valve module further includes an additional external port 39, which is connected to the gas return port 103 of the outdoor unit through a third pipeline 23. In addition, an additional connecting external port 391 arranged at one end opposite to the additional external port 39 in the valve module is further provided. The additional external port 39 is connected to the additional connecting external port 391 through a direct-through pipeline, thereby achieving the stacked connection of the plurality of valve modules as described above. The valve module further comprises a third flow path 318 extending from the additional external port 39 to each of the second internal ports 332, 334. The third flow path comprises a third flow path main path and a plurality of third flow path branches 3181, 3182 extending from the third flow path main path to each of the second internal ports. Each of the third flow path branches 3181, 3182 is provided with additional control valve 532, 534, respectively. When the valve modules 31' and 32' with such structure are being used, the local cut-off step further includes: closing the additional control valve on the third flow path branch corresponding to the indoor unit with leakage, while if leakage is still detected in the indoor unit with leakage after executing the local cut-off step, closing all additional control valves. Similarly, taking the indoor unit 491 as an example, when the sensor 406 associated with it detects refrigerant leakage, the control device executes the local cut-off step, including: closing the indoor unit throttling element 404 of the indoor unit, and the branch control valve 531 on the second flow path branch 3171 and the additional control valve 532 on the third flow path branch 3181 connected to the indoor unit in the valve module 31', and when leakage is still detected in the indoor unit with leakage after execution of the local cut-off step, closing the main path control valve 51, all branch control valves 531, 533 and additional control valves 532, 534 of the valve module 31' connected to the indoor unit with leakage. The function of this control step is the same as that described in conjunction with FIG. 1 above, which will not be repeated here.

In addition, the valve module shown in FIG. 2 also comprises an economizer 38. Each of the first flow path branches includes: first flow path forward branches 3164, 3165 and first flow path return branches 3167, 3168. Each of the first flow path forward branches 3164, 3165 is respectively provided with a check valve 521, 523 that only allows fluid to flow to the corresponding first internal port 331, 333, and each of the first flow path return branches 3167, 3168 is respectively provided with a check valve 522, 524 that only allows fluid to flow to the first external port. The first flow path main path 316 is first divided into two branches 3163, 3166. Then, the first branch 3163 continues to be divided into several first flow path forward branches 3164, 3165, and the second branch 3166 continues to be divided into several first flow path return paths 3167, 3168. In other words, the respective first flow path return branches 3167, 3168 merges into the second branch 3166 before being connected to the first flow path main path 316 through the first path 381 of the economizer 38. Wherein, a divisional branch branches out from the second branch 3166 before or after the economizer 38 (to the left of the economizer 38 in the figure, or alternatively to the right of the economizer), where the divisional branch is connected to the third flow path main path 318 after passing through the additional throttling element 54 and the second path 382 of the economizer.

An economizer 38 is incorporated into the valve module 31' shown in FIG. 2, thereby improving system efficiency. In addition, this structure realizes the function of partially executing cooling mode and partially executing heating mode for indoor units connected to the same valve module, thereby making the heat pump systems more flexible and energy-saving. For example, taking the first valve module 31' as an example, when the indoor unit 491 executes the heating mode while the indoor unit 492 executes the cooling mode, when the refrigerant vapor from the outdoor unit passes through the second pipeline 22 and enters the first valve module 31' through the second flow path 317, the branch control valve 531 is opened and the branch control valve 533 is closed, and the additional control valve 532 is closed and the additional control valve 534 is opened. The refrigerant vapor from the second flow path 317 is condensed and heating at the indoor unit heat exchanger 405 after passing through the branch control valve 531. After being throttled by the indoor unit throttling element 404, the refrigerant is then divided into three parts after passing through the first flow path return branch 3168 and the first path 381 of the economizer 38. The first part of the refrigerant flows through the first flow path forward branch 3165 into the indoor unit 492, passes through the throttling element 414 (which can be fully opened), and returns to the suction port of the compressor from the third pipeline 23 after being evaporated and cooling at the indoor unit heat exchanger 415 and passing through the additional control valve 534. The second part of the refrigerant passes through the divisional branch, the additional throttling element 54, the second path 382 of the economizer, and returns to the suction port of the compressor from the third pipeline 23. The third part of the refrigerant passes through the main path control valve 51 of the first flow path, and is evaporated at the outdoor unit heat exchanger 13 before returning to the suction port of the compressor. At the same time, the indoor units connected to another valve module 32' can execute the heating mode, or also execute the same mode of partial heating and partial cooling. Therefore, the valve modules shown in FIG. 2 can flexibly meet the different needs of indoor units for cooling and heating. When partial indoor units execute the heating mode and partial indoor units execute the cooling mode, such valve modules can also recover some thermal energy.

According to another aspect, a valve module for connecting the outdoor unit of a heat pump system to a plurality of indoor units is further provided. The valve module comprises: a plurality of sets of first internal port 331, 333 and second internal port 332, 334 respectively connected to a first port 402, 412 and a second port 403, 413 of a plurality of indoor units; a first external port 311 connected to a liquid refrigerant port 101 of the outdoor unit and a second external port 312 connected to a gaseous refrigerant port 102 of the outdoor unit; a first flow path 316 extending from the first external port 311 to each of the first internal ports 331, 333, wherein the first flow path comprises: a first flow path main path 3160, and a plurality of first flow path branches 3161, 3162 extending from the first flow path main path to each of the first internal ports, where the first flow path main path is provided with a main path control valve 51; and a second flow path 317 extending from the second external port 312 to each of the second internal ports 332, 334, wherein the second flow path comprises: a second flow path main path 3170, and a plurality of second flow path branches 3171, 3172 extending from the second flow path main path to each of the second internal ports 332, 334, where each of the second flow path branches are respectively provided with branch control valves 531, 533. The valve module can be applied to the heat pump system to perform various controls, thereby achieving the function of local cut-off of a single indoor unit and the overall cut-off of the valve module.

In some embodiments, the valve module 31 can be controlled by a control device configured as a whole in the heat pump system, that is, the on and off of the respective valves is executed by receiving various control signals. In some embodiments, the valve module 31 can be configured with its own control device, which is connected to the main path control valve 51 and the branch control valves 531, 533, and configured to execute a local cut-off step upon receiving a signal indicating refrigerant leakage in any indoor unit connected to the valve module. The local cut-off step includes: closing the branch control valve corresponding to the indoor unit with leakage. Wherein, the control device is further configured to close the main path control valve and all branch control valves when receiving a signal indicating that there is still leakage in the indoor unit with leakage after executing the local cut-off step.

In some embodiments, the valve module also comprises an additional external port 39, which is connected to a gas return port 103 of the outdoor unit. Wherein, the valve module comprises a third flow path 318 extending from the additional external port 39 to each of the second internal ports 332, 334. The third flow path comprises a third flow path main path and a plurality of third flow path branches 3181, 3182 extending from the third flow path main path to each of the second internal ports, where each of the third flow path branches is provided with an additional control valve 532, 534, respectively. In some embodiments, each of the first flow path branches includes: first flow path forward branches 3164, 3165 and first flow path return branches 3168, 3167. Each of the first flow path forward branches is provided with a check valve 521, 523 that only allows fluid to flow to the corresponding first internal port, and each of the first flow path return branches is provided with a check valve 522, 524 that only allows fluid to flow to the first external port. The valve module further comprises an economizer 38. The respective first flow path return branches 3168, 3167, after merging with each other, is connected to the first flow path main path 316 after passing through a first path 381 of the economizer. Wherein, a divisional branch branches out before or after the economizer, and the divisional branch is connected to the third flow path main path 318 after passing through the additional throttling element 54 and the second path 382 of the economizer.

In some embodiments, the valve module 31 can be configured with its own control device, which is configured to execute a local cut-off step upon receiving a signal indicating refrigerant leakage in any indoor unit connected to the valve module. The local cut-off step includes: closing the branch control valve corresponding to the indoor unit with leakage and closing the additional control valve corresponding to the indoor unit with leakage. Wherein, the control device is further configured to close the main path control valve, all branch control valves, and all additional control valves when receiving a signal indicating there is still leakage in the indoor unit with leakage after executing the local cut-off step.

Figure 3:
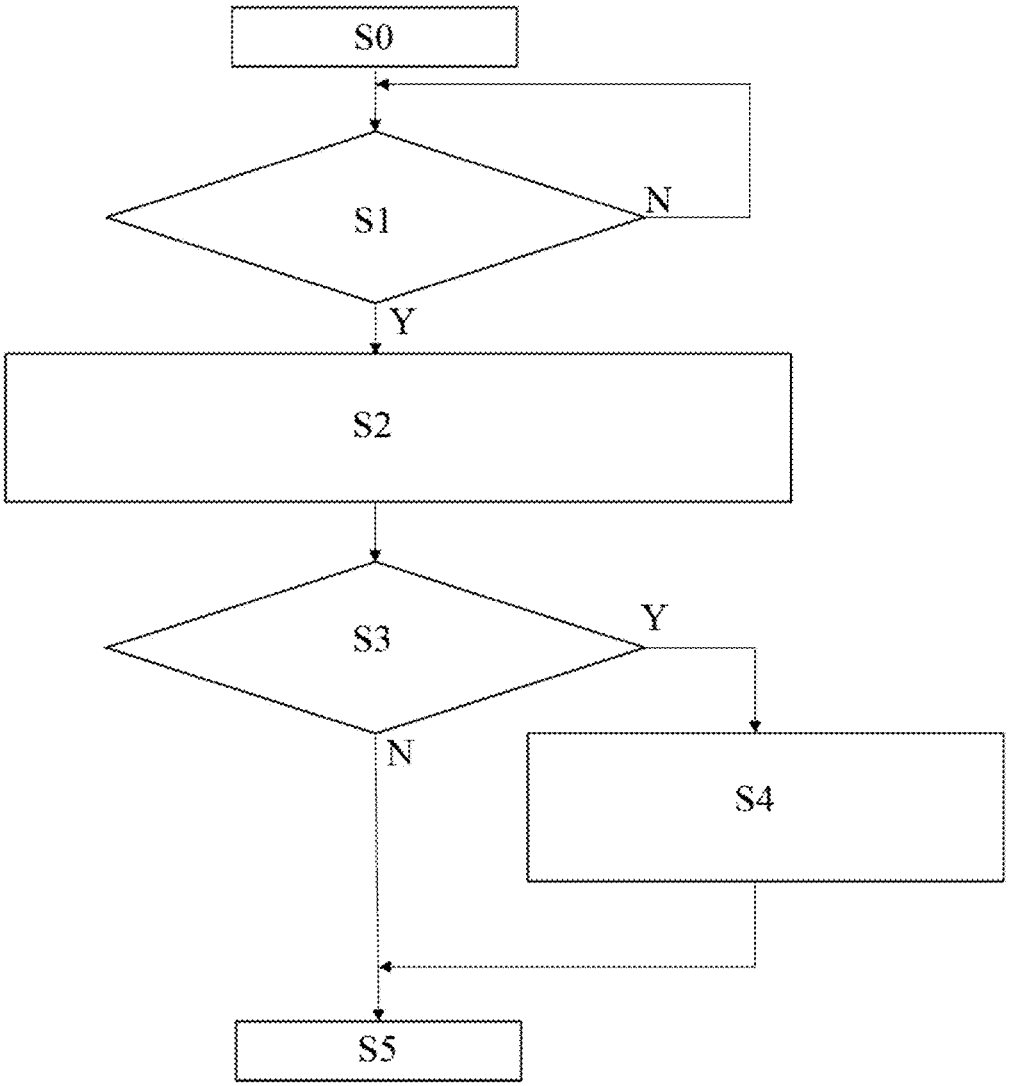
FIG. 3 shows a schematic diagram of a control method for a heat pump system.

With continued reference to FIG. 3, a schematic diagram of a control method for a heat pump system is shown. The control method can be applied to the aforementioned heat pump system, for example, to a heat pump system comprising an outdoor unit, a plurality of indoor units, and at least one valve module, where each of the valve modules connects the outdoor unit to at least two indoor units of the plurality of indoor units. The method comprises: S0: starting; S1: detecting for refrigerant leakage, and executing a local cut-off step S2 upon detection of refrigerant leakage in any indoor unit, while returning to continuous detection if leakage is not detected. Wherein, the local cut-off step S2 may include: closing the indoor unit throttling element of the indoor unit with leakage; and closing the branch control valve on the second flow path branch extending from the second external port to the second internal port corresponding to the indoor unit with leakage in the valve module connected to the indoor unit with leakage.

In some embodiments, the method further comprises: after executing the local cut-off step S2 for a certain period of time, executing step S3 of determining whether there is still leakage in the indoor unit with leakage; when it is detected that there is still leakage in the indoor unit with leakage, executing step S4 of closing the main path control valve on the first flow path main path of the first flow path extending from the first external port to each of the first internal ports in the valve module connected to the indoor unit with leakage, and closing all branch control valves in the valve module connected to the indoor unit with leakage; and then, proceeds to step S5 ending, where if no leakage is detected in the indoor unit with leakage, directly proceeds to step S5 ending.

In some embodiments, the step S3 of detecting there is still leakage in the indoor unit with leakage includes: keeping the fan of the indoor unit heat exchanger of the indoor unit with leakage continuously operating and sensing the presence of refrigerant leakage after a certain time delay (less than 10 minutes).

In some embodiments, as for the heat pump system shown in FIG. 2, the local cut-off step S2 further comprises: closing the additional control valve on the third flow path branch extending from the additional external port to the second internal port corresponding to the indoor unit with leakage in the valve module connected to the indoor unit with leakage. In some embodiments, accordingly, the step S4 comprises closing the main path control valve on the first flow path main path of the first flow path extending from the first external port to each of the first internal ports in the valve module connected to the indoor unit with leakage; and closing all branch control valves and all additional control valves in the valve module connected to the indoor unit with leakage.

The specific embodiments described above in the present application are merely intended to describe the principles of the present application more clearly, wherein various components are clearly shown or described to facilitate the understanding of the principles of the invention. Those skilled in the art may, without departing from the scope of the present application, make various modifications or changes to the present application. Therefore, it should be understood that these modifications or changes should be included within the scope of patent protection of the present application.

What is claimed is:

1. A valve module for connecting an outdoor unit of a heat pump system to a plurality of indoor units, wherein the valve module comprises:

a plurality of sets of a first internal port and a second internal port respectively connected to a first port and a second port of a plurality of indoor units;

a first external port connected to a liquid refrigerant port of an outdoor unit and a second external port connected to a gaseous refrigerant port of the outdoor unit;

a first flow path extending from the first external port to each of the first internal ports, wherein the first flow path comprises: a first flow path main path and a plurality of first flow path branches extending from the first flow path main path to each of the first internal ports, where the first flow path main path is provided with a main path control valve;

a second flow path extending from the second external port to each of the second internal ports, wherein the second flow path comprises: a second flow path main path and a plurality of second flow path branches extending from the second flow path main path to each of the second internal ports, where each second flow path branch is provided with a branch control valve; and an additional external port connected to a gas return port of the outdoor unit.

2. The valve module according to claim 1, wherein the valve module further comprises: a control device connected to the main path control valve and all branch control valves, and configured to execute a local cut-off step upon receiving a signal indicating refrigerant leakage in any indoor unit connected to the valve module, where the local cut-off step comprises: closing the branch control valve corresponding to the indoor unit with leakage, wherein, the control device is further configured to close the main path control valve and all branch control valves upon receiving a signal indicating there is still leakage in the indoor unit with leakage after executing the local cut-off step.

3. The valve module according to claim 1, wherein the valve module further comprises a third flow path extending from the additional external port to each of the second internal ports, and the third flow path comprises a third flow path main path and a plurality of third flow path branches extending from the third flow path main path to each of the second internal ports, where each third flow path branch is provided with an additional control valve.

4. The valve module according to claim 3, wherein each first flow path branch comprises: a first flow path forward branch and a first flow path return branch, where each first flow path forward branch is provided with a check valve that only allows fluid to flow to a corresponding first internal port, and each first flow path return branch is provided with a check valve that only allows fluid to flow to the first external port, and the valve module further comprises an economizer, where each of the first flow path return branches, after merging with each other, is connected to the first flow path main path after passing through a first path of the economizer, and where a divisional branch branches out before or after the economizer, and the divisional branch is connected to the third flow path main path after passing through an additional throttling element and a second path of the economizer.

5. The valve module according to claim 3, wherein the valve module further comprises a control device configured to execute a local cut-off step upon receiving a signal indicating refrigerant leakage in any indoor unit connected to the valve module, where the local cut-off step comprises: closing the branch control valve corresponding to the indoor unit with leakage, and closing the additional control valve corresponding to the indoor unit with leakage;

wherein, the control device is further configured to close the main path control valve, all branch control valves and all additional control valves, upon receiving a signal indicating there is still leakage in the indoor unit with leakage after executing the local cut-off step.

6. The valve module according to claim 3, wherein the valve comprises: a first connecting external port connected to the first external port through a direct-through pipeline, a second connecting external port connected to the second external port through a direct-through pipeline, and an additional connecting external port connected to the additional external port through a direct-through pipeline.

7. A valve module for connecting an outdoor unit of a heat pump system to a plurality of indoor units, wherein the valve module comprises:

a plurality of sets of a first internal port and a second internal port respectively connected to a first port and a second port of the plurality of indoor units;

a first external port connected to a liquid refrigerant port of an outdoor unit and a second external port connected to a gaseous refrigerant port of the outdoor unit; and an additional external port connected to a gaseous refrigerant port of the outdoor unit.

8. The valve module according to claim 7, wherein the valve module further comprises a first flow path extending from the first external port to each of the at least one first internal ports.

9. The valve module according to claim 8, wherein the first flow path comprises: a first flow path main path and a plurality of first flow path branches extending from the first flow path main path to each of the first internal ports.

10. The valve module according to claim 9, where the first flow path main path is further provided with a main path control valve.

11. The valve module according to claim 8, wherein the valve module further comprises a second flow path extending from the second external port to each of the second internal ports.

12. The valve module according to claim 11, wherein the second flow path comprises: a second flow path main path and a plurality of second flow path branches extending from the second flow path main path to each of the second internal ports, where each second flow path branch is provided with a branch control valve.

13. The valve module according to claim 11, wherein the valve module further comprises a third flow path extending from the additional external port to each of the second internal ports.

14. The valve module according to claim 13, wherein the third flow path comprises a third flow path main path and a plurality of third flow path branches extending from the third flow path main path to each of the second internal ports.

15. The valve module according to claim 14, wherein each third flow path branch is provided with an additional control valve.

* * * * *